US009731307B2

(12) United States Patent
Chernik et al.

(10) Patent No.: US 9,731,307 B2
(45) **Date of Patent: *Aug. 15, 2017**

(54) METERED DOSING BOTTLE

(71) Applicant: Ecolab USA Inc., St. Paul, MN (US)

(72) Inventors: Ryan A. Chernik, St. Anthony, MN (US); Brian Philip Carlson, Lakeville, MN (US); Richard J. Mehus, Richfield, MN (US)

(73) Assignee: Ecolab USA Inc., Saint Paul, MN (US)

( * ) Notice: Subject to any disclaimer, the term of this patent is extended or adjusted under 35 U.S.C. 154(b) by 51 days.

This patent is subject to a terminal disclaimer.

(21) Appl. No.: 14/824,760

(22) Filed: Aug. 12, 2015

(65) Prior Publication Data

US 2015/0343469 A1 Dec. 3, 2015

Related U.S. Application Data

(63) Continuation of application No. 14/016,290, filed on Sep. 3, 2013, now Pat. No. 9,132,440, which is a (Continued)

(51) Int. Cl.

| | |
|---|---|
| ***B67D 7/58*** | (2010.01) |
| ***B05B 11/00*** | (2006.01) |
| ***B05B 15/00*** | (2006.01) |

(52) U.S. Cl.

CPC ..... *B05B 11/0037* (2013.01); *B05B 11/0089* (2013.01); *B05B 11/3047* (2013.01); *B05B 15/005* (2013.01); *B05B 11/0059* (2013.01)

(58) Field of Classification Search

CPC ..... B67D 7/163; B65D 83/32; B05B 11/0037; B05B 11/0005

(Continued)

(56) References Cited

U.S. PATENT DOCUMENTS 570,759 A 11/1896 Law
856,543 A 6/1907 Nolan
(Continued)

FOREIGN PATENT DOCUMENTS

DE 3121591 A1 3/1982
DE 4139534 A1 6/1993
(Continued)

OTHER PUBLICATIONS

Ecolab USA Inc., PCT/IB2011/053157, filed Jul. 14, 2011, "The International Search Report and the Written Opinion of the International Searching Authority, or the Declaration" mailed Feb. 6, 2012, 12 pages.

*Primary Examiner* — Patrick M Buechner
*Assistant Examiner* — Michael J Melaragno
(74) *Attorney, Agent, or Firm* — McKee, Voorhees & Sease, PLC

(57) ABSTRACT

An apparatus and method for accurately measuring and dispensing a predetermined amount of product from a dispensing system to a given surface area is disclosed. The dispensing system (100) includes a container (102) having a main chamber (106) to hold product and a dosing chamber (108) having an opening (110) in communication with the main chamber (106). The dosing chamber (108) is configured to hold a metered amount of product (112) received from the main chamber (106). A spray head (128) when connected to the container (102) is brought into operable and fluid communication with a dip tube (114), optionally cut to a selected length, which is positioned within the dosing chamber (108) for dispensing by activation of a trigger (136) product (112) to a given surface area or air space.

20 Claims, 10 Drawing Sheets

Related U.S. Application Data continuation of application No. 13/080,049, filed on Apr. 5, 2011, now abandoned.

(60) Provisional application No. 61/367,613, filed on Jul. 26, 2010.

(58) Field of Classification Search
USPC ..... 222/129, 14, 382, 464.4, 464.1, 383.1
See application file for complete search history.

(56) References Cited

U.S. PATENT DOCUMENTS

| | | | |
|---|---|---|---|
| 1,700,659 | A | 1/1929 | Bergen |
| 2,204,104 | A | 6/1940 | Masters |
| 2,331,117 | A | 10/1943 | Goodhue et al. |
| 2,370,820 | A | 3/1945 | Stott |
| 2,616,593 | A | 11/1952 | Leibenhaut |
| 3,045,872 | A | 7/1962 | Hronas et al. |
| 3,060,942 | A | 10/1962 | Finlay |
| 3,107,031 | A | 10/1963 | Adams |
| 3,724,723 | A | 4/1973 | Slavinski |
| 3,878,973 | A | 4/1975 | Riccio |
| 4,273,271 | A | 6/1981 | Tiger |
| 4,418,843 | A | 12/1983 | Jackman |
| 4,666,065 | A | 5/1987 | Ohren |
| 4,893,732 | A | 1/1990 | Jennings |
| 5,000,353 | A | 3/1991 | Kostanecki et al. |
| 5,038,965 | A | 8/1991 | Cater |
| 5,054,660 | A | 10/1991 | Sherman et al. |
| 5,067,637 | A | 11/1991 | Aurness et al. |
| 5,092,497 | A | 3/1992 | Toedter |
| 5,165,576 | A | 11/1992 | Hickerson |
| 5,251,792 | A | 10/1993 | Sheen |
| 5,261,575 | A | 11/1993 | Keller |
| 5,267,673 | A | 12/1993 | Crosnier et al. |
| 5,279,450 | A | 1/1994 | Witt, Jr |
| 5,398,846 | A | 3/1995 | Corba et al. |
| 5,405,055 | A | 4/1995 | Hester |
| 5,497,916 | A | 3/1996 | Hester |
| 5,518,150 | A | 5/1996 | Witt, Jr. |
| 5,556,011 | A | 9/1996 | Jennings et al. |
| 5,695,093 | A | 12/1997 | Lucius |
| 5,810,203 | A | 9/1998 | Brennan |
| 5,871,122 | A | 2/1999 | Klima et al. |
| 5,884,816 | A | 3/1999 | Hinze |
| 5,890,624 | A | 4/1999 | Klima et al. |
| 5,944,223 | A | 8/1999 | Klima et al. |
| 6,123,230 | A | 9/2000 | Klima et al. |
| 6,186,367 | B1 | 2/2001 | Harrold |
| 6,264,058 | B1 | 7/2001 | Porter et al. |
| 6,290,102 | B1 | 9/2001 | Jennings et al. |
| 6,343,723 | B1 | 2/2002 | Hickerson |
| 6,360,918 | B1 | 3/2002 | Butler |
| 6,364,172 | B1 | 4/2002 | Maas et al. |
| 6,378,741 | B1 | 4/2002 | Loertscher |
| 6,494,350 | B2 | 12/2002 | Kelley |
| 6,550,694 | B1 | 4/2003 | Foster et al. |
| 6,659,311 | B2 | 12/2003 | Prueter |
| 6,675,845 | B2 | 1/2004 | Volpenheim et al. |
| 6,695,179 | B2 | 2/2004 | Mandile |
| 6,701,975 | B1 | 3/2004 | Neal |
| 6,871,760 | B1 | 3/2005 | Snider |
| 7,111,762 | B2 | 9/2006 | Saunders et al. |
| 7,118,012 | B2 | 10/2006 | Butler |
| 7,296,590 | B2 | 11/2007 | Kitagawa |
| 7,637,397 | B2 | 12/2009 | Conway et al. |
| 8,038,040 | B2 | 10/2011 | Dennis |
| D654,813 | S | 2/2012 | Jennings et al. |
| 8,297,479 | B2 | 10/2012 | Hoefing et al. |
| 8,322,576 | B2 | 12/2012 | Gioia |
| D677,571 | S | 3/2013 | Jennings et al. |
| 9,132,440 | B2 * | 9/2015 | Chernik ..... B05B 11/0037 |
| 2002/0084291 | A1 | 7/2002 | Kelley |
| 2003/0089744 | A1 | 5/2003 | Mandile |
| 2003/0116589 | A1 | 6/2003 | DeLaforcade |
| 2003/0213820 | A1 | 11/2003 | Sherk, Jr. et al. |
| 2004/0118875 | A1 | 6/2004 | Saunders et al. |
| 2006/0289679 | A1 | 12/2006 | Johnson et al. |
| 2008/0315018 | A1 | 12/2008 | Withers |
| 2009/0212077 | A1 | 8/2009 | Carden |
| 2011/0108581 | A1 | 5/2011 | Dennis |
| 2012/0006856 | A1 | 1/2012 | Dennis |
| 2012/0234872 | A1 | 9/2012 | Good et al. |
| 2012/0241474 | A1 | 9/2012 | Dennis |
| 2012/0241475 | A1 | 9/2012 | Dennis |

FOREIGN PATENT DOCUMENTS

| | | | |
|---|---|---|---|
| EP | 0015560 | A1 | 9/1980 |
| EP | 0010965 | B1 | 5/1982 |
| EP | 0217416 | B1 | 1/1991 |
| EP | 0875461 | B1 | 12/1999 |
| EP | 0911616 | B1 | 8/2001 |
| GB | 2129774 | A | 5/1984 |
| GB | 2324297 | A | 10/1998 |
| GB | 2369609 | A | 6/2002 |
| WO | 9325446 | A1 | 12/1993 |
| WO | 9607599 | A1 | 3/1996 |
| WO | 9749974 | A1 | 12/1997 |

* cited by examiner

METERED DOSING BOTTLE

CROSS-REFERENCE TO RELATED APPLICATIONS

This is a continuation application of U.S. Ser. No. 14/016,290, filed Sep. 3, 2013, which is a continuation application of U.S. Ser. No. 13/080,049 filed Apr. 5, 2011, which is a non-provisional application of Ser. No. 61/367,613 filed Jul. 26, 2010, which are hereby incorporated by reference in their entirety.

BACKGROUND OF THE INVENTION

Field of the Invention

This invention relates generally to an apparatus and method for accurately measuring and dispensing product, and more particularly to an effective and efficient apparatus and method of applying a predetermined amount of product to a given surface area using a metered dosing bottle.

Description of Prior Art

Chemical products dispensed from a container are often used to clean or kill germs on surfaces, such as bathroom sinks, tubs, kitchen counters, etc. The chemicals, however, can be ineffective if the proper amount per surface area is not applied. Moreover, applying too much of the product per surface area can lead to waste. In some situations, too much product can lead to damage to the covered surface area.

The present invention addresses these problems and provides for an effective and efficient apparatus and method for accurately measuring and applying a predetermined amount of product to a given surface area.

In addition, the present invention addresses dispensing product to a given surface area from a dosing chamber within a spray bottle that holds a selectable amount of product.

SUMMARY OF THE INVENTION

In one embodiment, the invention is a dispensing system. The dispensing system includes a container body extending upward and terminating in a neck portion. The container includes a main chamber to hold product and a dosing chamber having an opening in communication with the main chamber. The dosing chamber is configured to hold a metered amount of product received from the main chamber. A spray nozzle is removably connected to the container and a dip tube is connected in fluid communication with the spray head and positioned within the dosing chamber.

In another embodiment, the invention is a bottle for a dispensing system. The bottle includes a container body extending upward and terminating in a neck portion. The bottle also includes a main chamber to hold product and a dosing chamber having a chamber opening in communication with the main chamber. The dosing chamber is configured to hold a metered amount of product received from the main chamber.

In another embodiment, the invention is a spray head for a dispensing system. The spray head includes a neck having a coupler for selectively attaching the spray head to a dispensing bottle, a spraying nozzle configured to dispense product, and a pickup tube connected in fluid communication with the spraying nozzle. The bottom end of the pickup tube includes a nozzle configured for selectively coupling to a dip tube.

In another embodiment, the invention is a method for a dispensing system. The method includes providing a bottle having a dosing chamber, a main chamber, and a dip tube within the dosing chamber. The main chamber is filled with a product. A spray nozzle having a pickup tube terminating in a connector nozzle is removably secured to the bottle for coupling the connector nozzle to the pickup tube. Tipping the spray bottle from a generally upright position fills the dosing chamber with product from the main chamber. In one aspect, air is prevented from entering the dip tube when the dosing chamber is empty by closing a float valve secured to the dip tube within the dosing chamber.

BRIEF DESCRIPTION OF THE DRAWINGS

While the Specification concludes with the claims particularly pointing out and distinctly claiming the invention, it is believed that the present invention will be better understood from the following description taken in conjunction with the accompanying drawings, in which:

DETAILED DESCRIPTION OF THE PREFERRED EMBODIMENTS

In the following detailed description, reference is made to the accompanying drawings, wherein like numerals represent like parts throughout the several views that form a part hereof, and which is shown by way of illustration specific embodiments in which the invention may be practiced. These embodiments are described in sufficient detail to enable those skilled in the art to practice the invention, and it is to be understood that other embodiments may be utilized and that logical changes may be made without departing from the spirit and scope of the present invention. The following detailed description is, therefore, not to be taken in a limiting sense, and the scope of the present invention is defined only by the claims and equivalences thereof.

Embodiments of the present invention are directed to a dispensing system that provides a predetermined amount of product to a given surface area. In this invention, a container includes a dosing chamber that holds a select amount of product. A dispensing assembly that is in fluid communication with the dosing chamber transfers the product in the dosing chamber to the surface for which it is to be applied.

Figure 1:
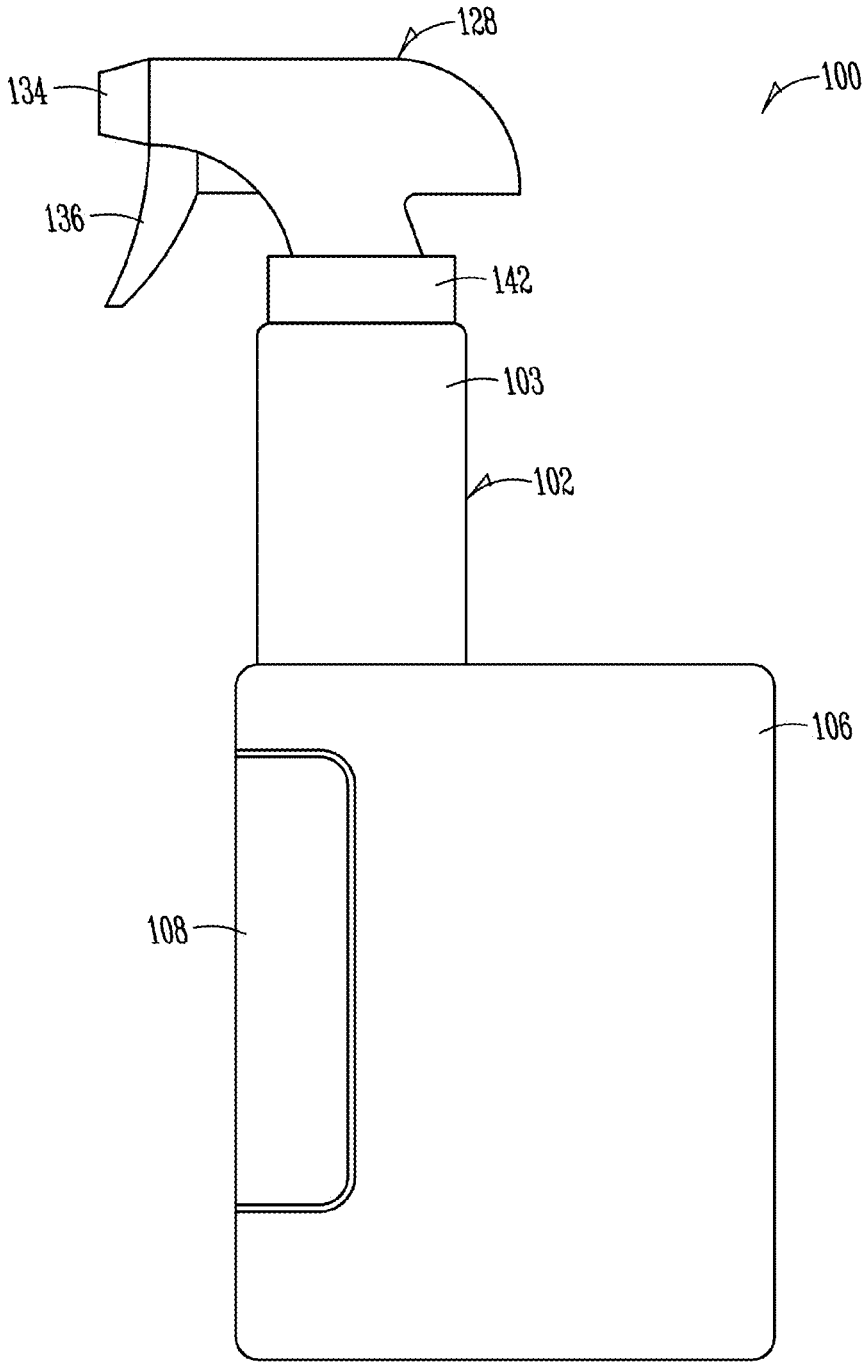
FIG. 1 is a side view of a dispensing system of the present invention.

Referring now to FIG. 1, there is generally disclosed at 100 is a dispensing system according to one embodiment of the present invention. The dispensing system 100 includes a container designated generally as 102. The container 102 extends upwardly and terminates in a neck portion 103 having attachment means for removably securing the collar 142 associated with the spray head 128 to the neck portion 103 of the container 102. The container 102 includes a main chamber 106 and a dosing chamber 108, a spray head 128 is removably secured by collar 142 to container 102. The spray head 128 includes a trigger 136 in operable communication with a pump (not shown) for pumping product from the container 102 through nozzle 134.

Figure 2A:
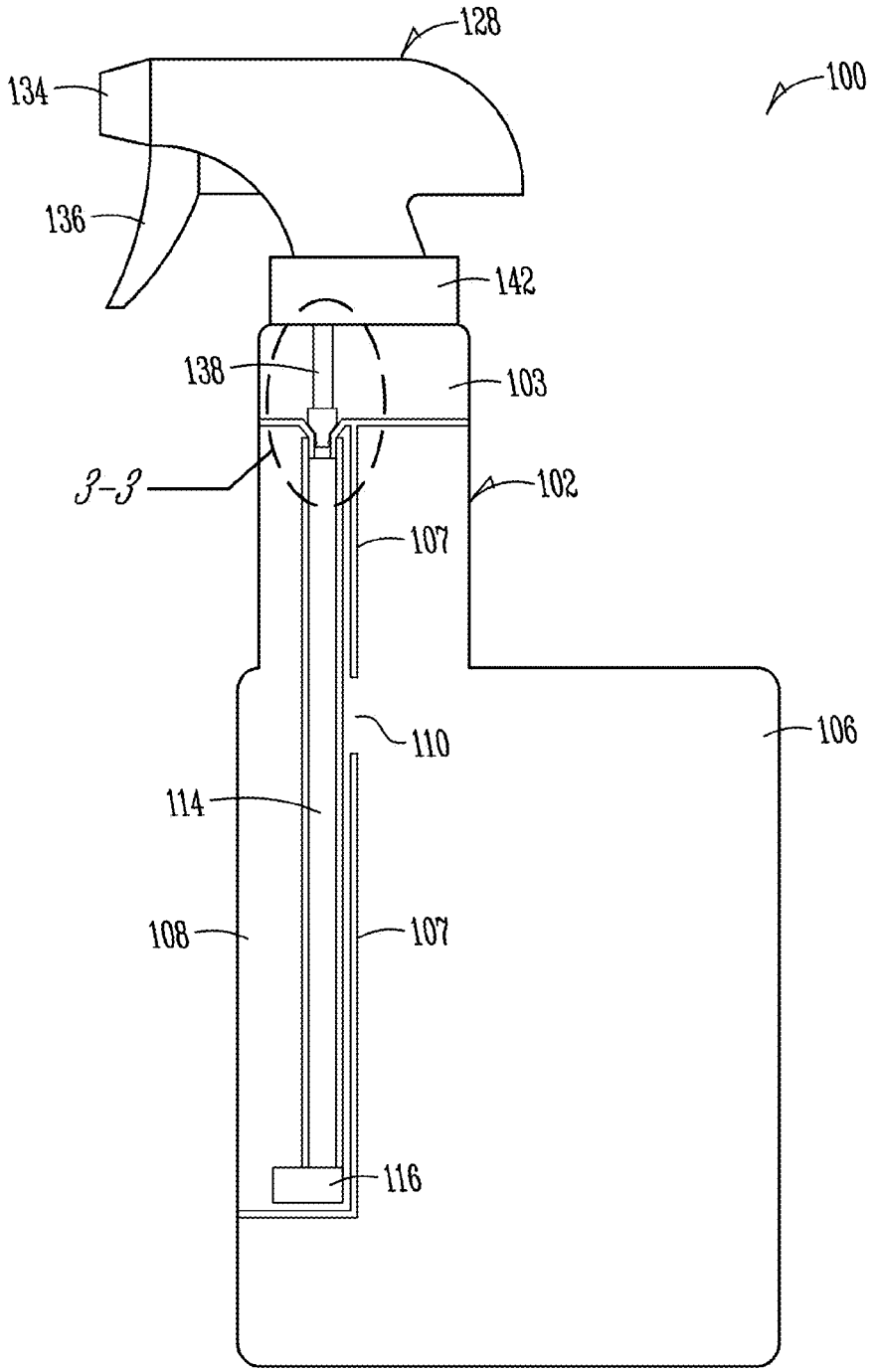
FIG. 2A is a translucent side view of one embodiment of the dispensing system of FIG. 1.
Figure 2B:
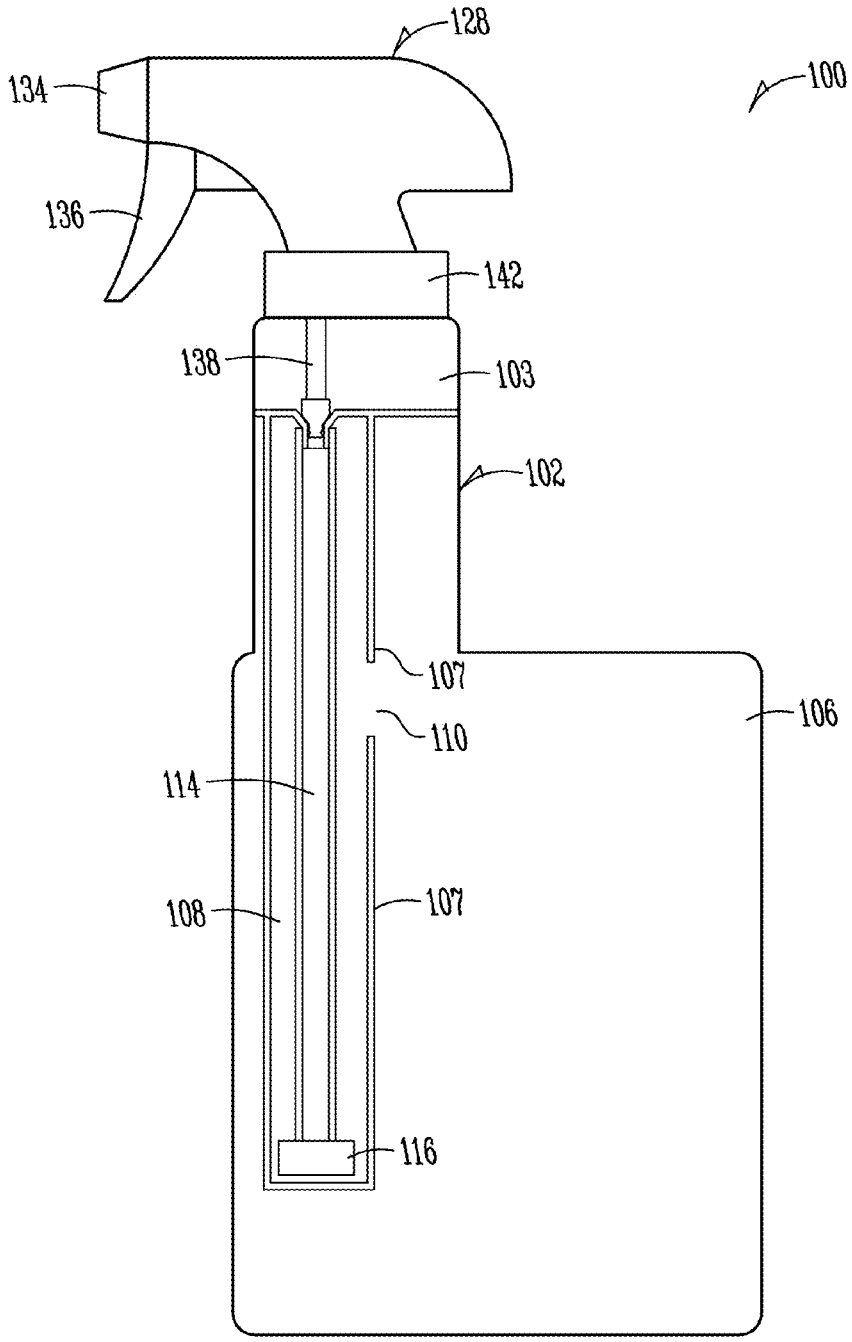
FIG. 2B is a translucent side view of another embodiment of the dispensing system of FIG. 1.

As best illustrated in FIG. 2A, the main chamber 106 and dosing chamber 108 are separated by a divider 107. The main chamber 106 is used to store product. The dosing chamber 108 stores a select amount of the product. The main chamber 106 is in open communication with the dosing chamber 108 via opening 110. The product in the dosing chamber 108 is dispensed by the dispensing system 100 using spray head 128. The spray head 128 is coupled to the container via a collar 142 known in the art. The spray head 128 includes a pickup tube 138 connected in fluid communication with a pump (not shown) that is within the spray head 128. FIG. 2B illustrates another embodiment of the dispensing system 100 shown in FIG. 1. In FIG. 2A the dosing chamber 108 is integral with the container 102. For example, one or more walls of the container 102 form the dosing chamber 108. In FIG. 2A, the dosing chamber 108 is made up of vessel walls that are separate from the container 102, and the dosing chamber 108 is thereby removable from the inside of the container 102.

Figure 3:
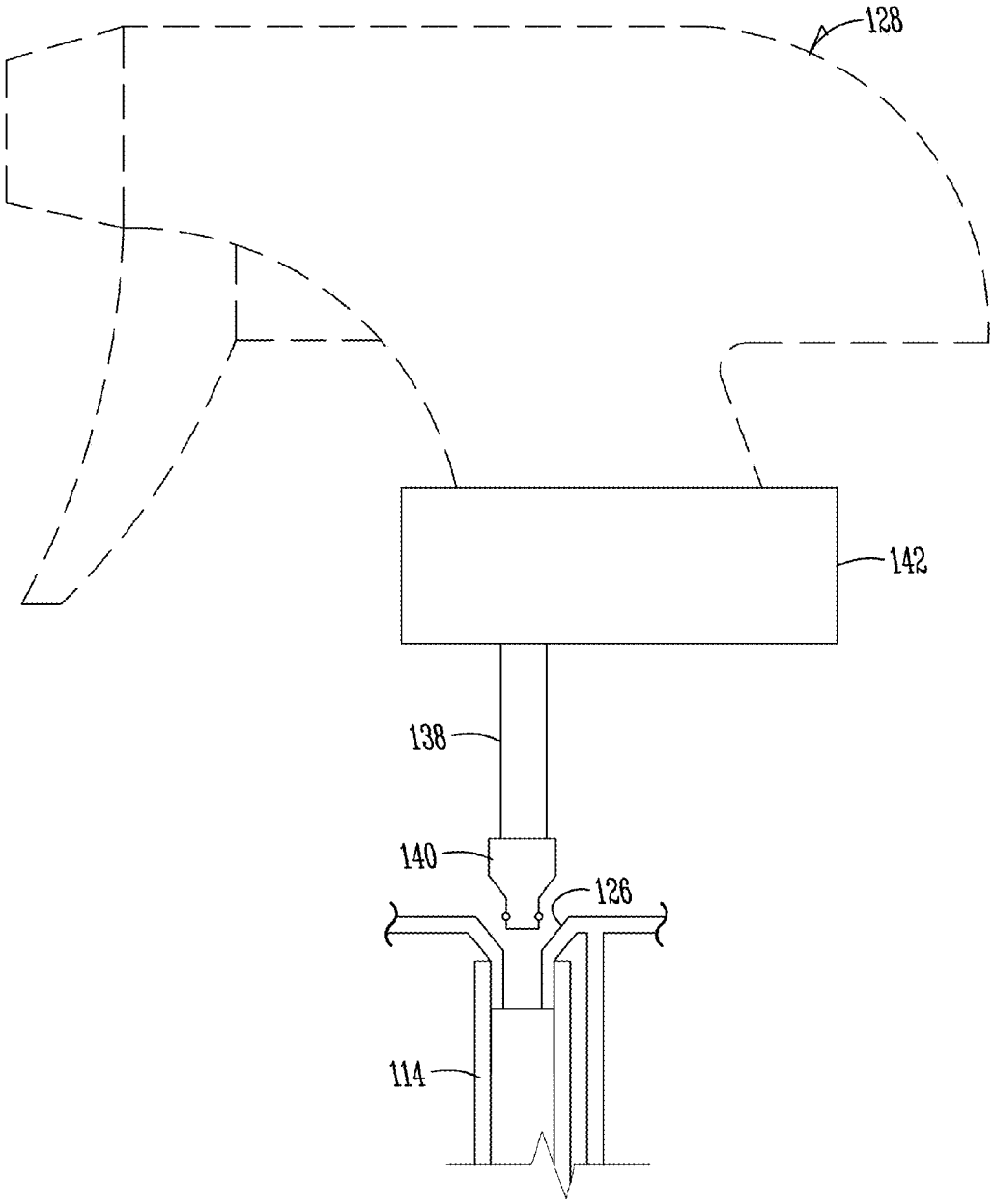
FIG. 3 is a perspective view taken along line 3-3 in FIG. 2A.

As best illustrated in FIG. 3, the lower terminal end of the pickup tube 138 includes a nozzle 140. The nozzle 140 is removably and sealably received within nozzle interface 126. The nozzle interface 126 is secured at the neck portion 103 of container 102 and by its position only permits the spray head 128 to be secured to the container 102 having proper alignment relative to the container 102 as illustrated in FIG. 2. The dip tube 114 is secured to the dip tube nozzle interface 126 and extends generally vertically downward into the dosing chamber 108. A float valve assembly 116 is secured at or near the bottom terminal end of the dip tube 114. The nozzle interface 126 may be removably secured at the neck portion 103 of the container 102 as shown in FIG. 2B to allow for removal of the dosing chamber 108, dip tube 14 and float valve assembly 116 from the container. In operation, a pump (not shown) that is known in the art and positioned within the spray head 128 is activated via trigger 136. As a result of activation of the trigger 136, product in the dosing chamber 108 is dispensed out nozzle 134 of the spray head 128. Repeated activation of the trigger 136 will dispense the entire product in the dosing chamber 108, or the product at least above the level of the float valve assembly 116.

Figure 4:
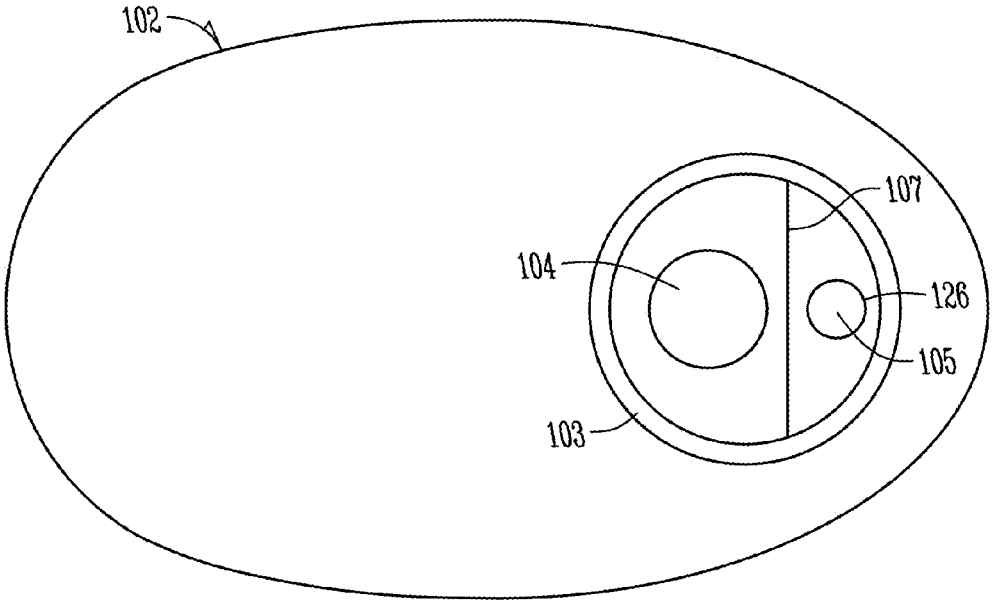
FIG. 4 is a top plan view of the container body of one embodiment of the present invention.
Figure 5A:
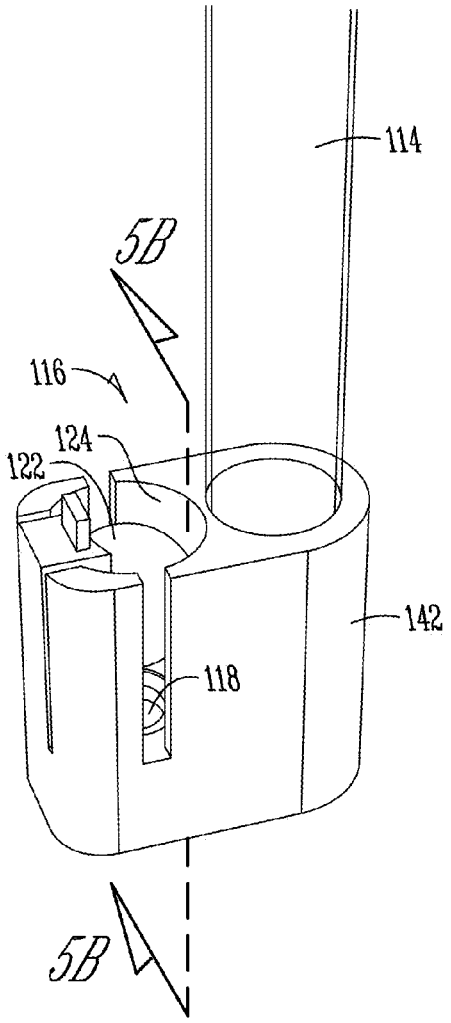
FIG. 5A is a perspective view of the float valve and dip tube illustrated in FIG. 2A.
Figure 5B:
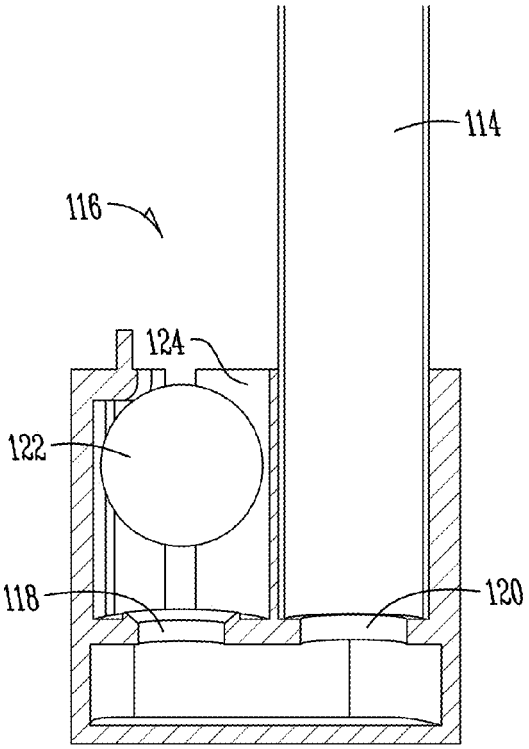
FIG. 5B is a side elevation cross-sectional view taken along line 5B-5B in FIG. 5A.

As illustrated in FIG. 4, the neck portion 103 includes a fill opening 104 and a dispense opening 105. The fill opening 104 is in fluid communication with the main chamber 106 in container 102. Similarly, the dispense opening 105 is in fluid communication with the dosing chamber 108 in container 102. The divider 107 within the neck portion 103 separates the fill opening 104 from the dispense opening 105. When the spray head 128 is separated from the container 102, the nozzle 140 is removed from within the nozzle interface 126. An O-ring or like sealing means known in the art may be used to seal the mating surfaces of the nozzle 140 and the nozzle interface 126. Since the nozzle 140 occupies the dispense opening 105 when spray head 128 is connected to container 102, removal of spray head 128 from container 102 separates the nozzle 140 from the nozzle interface 126 thereby providing access to the dispense opening 105. Likewise, removal of the spray head 128 from the container 102 provides access to the fill opening 104 in the neck portion 103 of container 102. The dip tube 114 remains in the dosing chamber 108 when the spray head 128 is separated from the container 102.

Figure 8A:
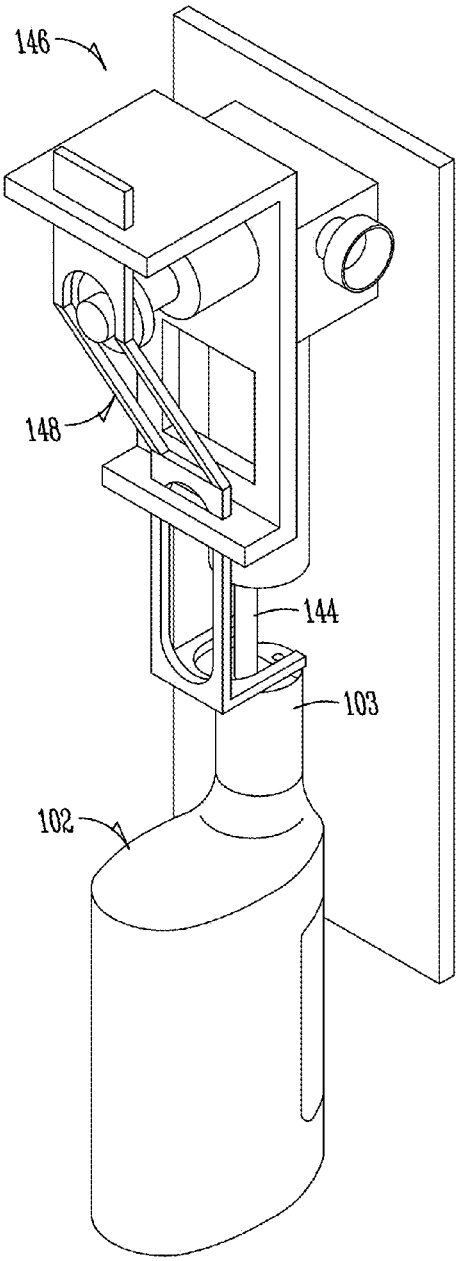
FIGS. 8A-B illustrate the filling of a main chamber.
Figure 8B:
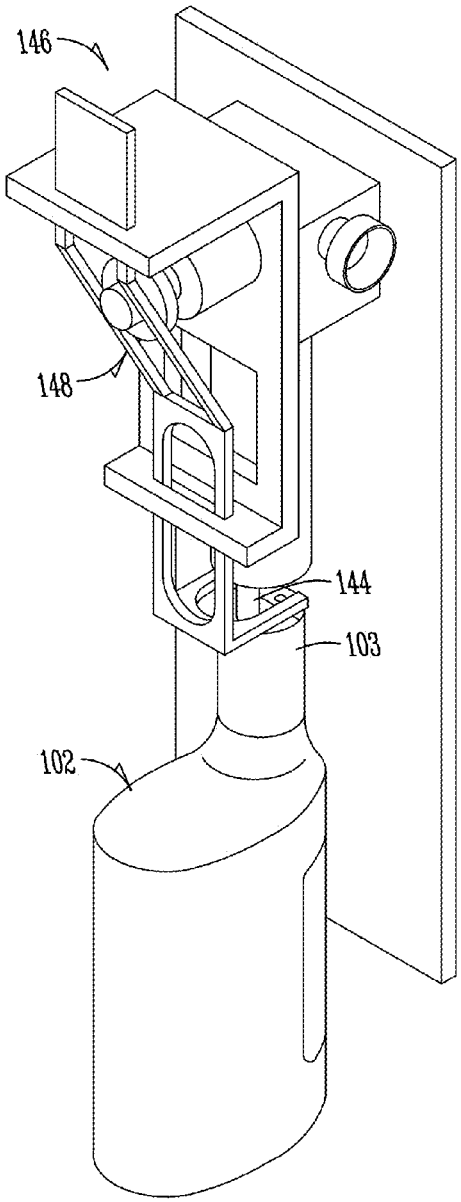

As best illustrated in FIG. 8A-B, the container 102 may be used in combination with a dispenser 146 for filling the main chamber 106 with a product. For example, the dispenser 146 may include a valve mechanism 148 for selectively controlling flow of product through fill tube 144. To fill the main chamber 106 of container 102 with the product, the spray head 128 is separated from the container 102 and the fill tube 144 is inserted into the fill opening 104 in the neck portion 103 of container 102. As the container 102 is lifted upward toward the valve mechanism 148, the fill tube 144 descends into the container 102 in the main chamber 106 separated from the dosing chamber 108 by divider 107. Further lifting upward on the fill mechanism 148 using the neck portion 103 of container 102 activates dispensing. During dispensing, the fill tube 144 is positioned at or near the bottom of container 102 to help reduce foaming when filling the main chamber 106 with product. When the main chamber 106 is full, the container 102 is removed from the dispenser 146 and the spray nozzle 128 is reattached to the container 102 using collar 142.

Figure 7:
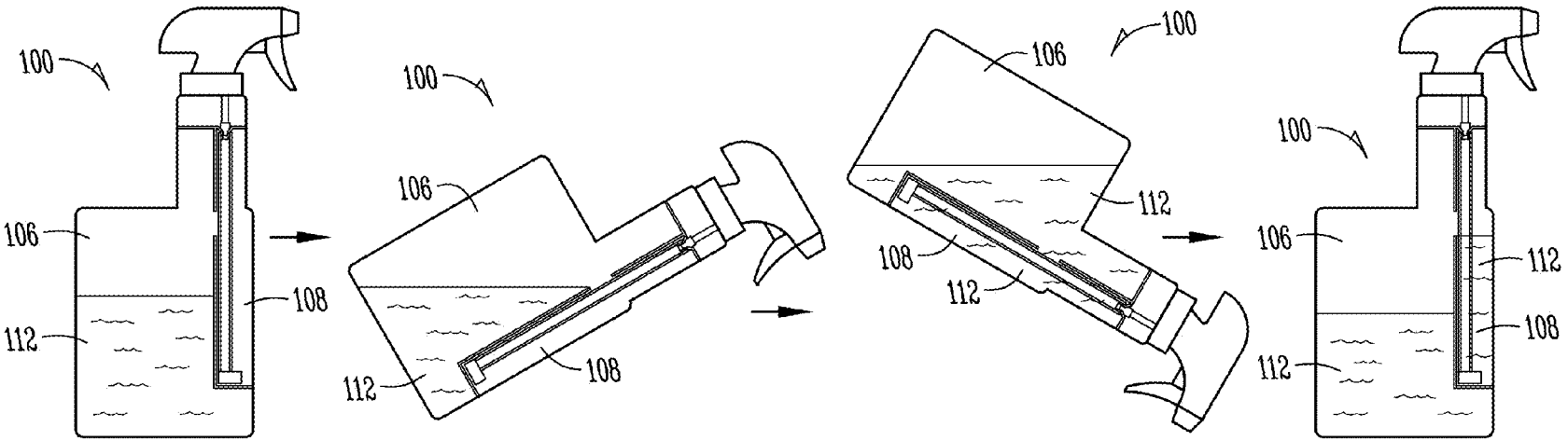
FIG. 7 illustrates the filling of a dosing chamber.

To fill the dosing chamber 108 with product from the main chamber 106, the dispensing system 100 starting from a generally upright position, is tilted as shown in FIG. 7 until product 112 from the main chamber 106 fills the dosing chamber 108 as shown. The dispensing system 100 is then returned to the generally upright spraying position now having a metered amount of product 112 in the dosing chamber 108. The spray head 128 is activated by repeated pumping of trigger 136 which dispenses the entire product in the dosing chamber 108 or at least the product above or at the level of the float valve assembly 116. Hence, a predetermined amount of product 112 can be dispensed by the spray head 128 onto a surface. To move more of the product 112 from the main chamber 106 into the dosing chamber 108, the dispensing system 100 is simply tilted allowing the product 112 in the main chamber 106 to pass through opening 110 between the main chamber 106 and dosing chamber 108 until the dosing chamber 108 becomes full. When the dispensing system 100 is then positioned generally upright, or in the spraying position, the correct amount of metered product 112 will be in the dosing chamber 108.

Figure 6A:
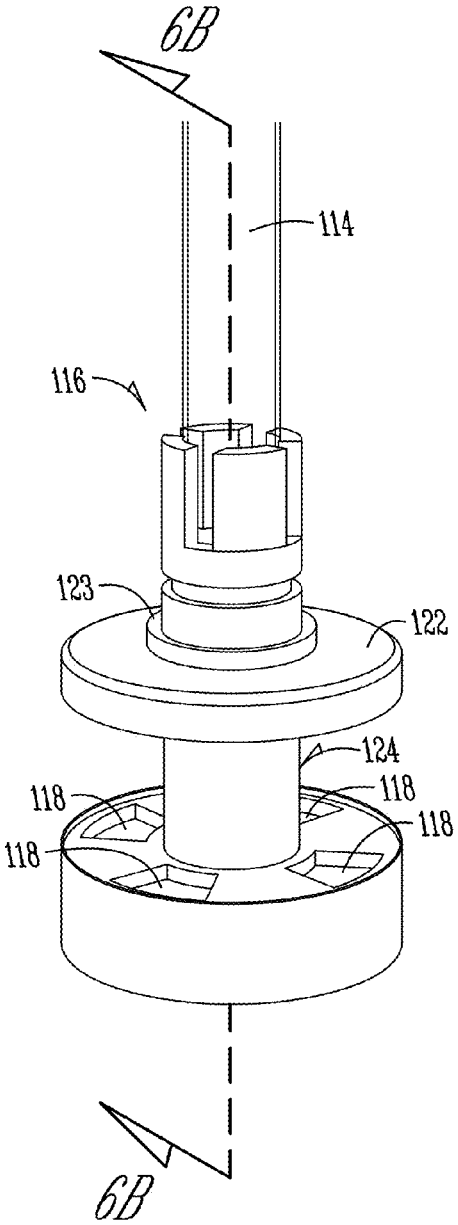
FIG. 6A is a perspective view of a check valve and dip tube shown in FIG. 2 according to an embodiment of the present invention.
Figure 6B:
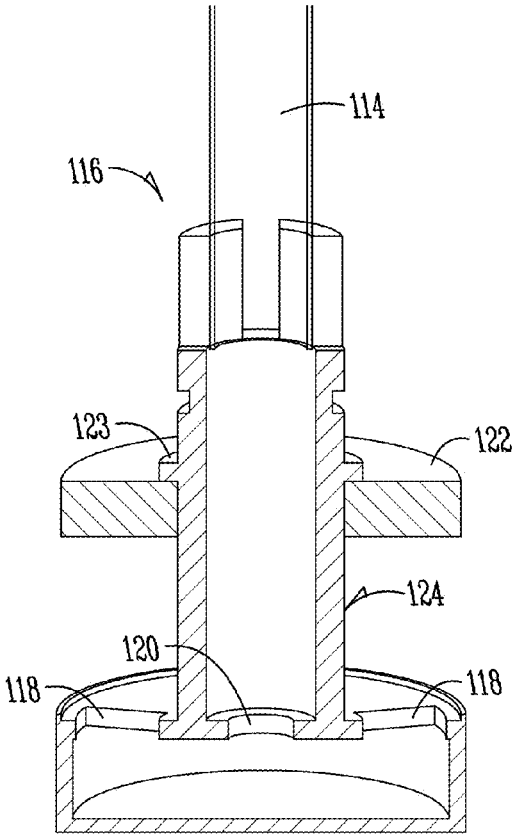
FIG. 6B is a side elevation cross-sectional view taken along line 6B-6B in FIG. 6A.

In another aspect of the present invention, the dip tube 114 includes a float valve assembly 116 at or near its terminal bottom end for preventing air from getting into the dip tube 114 and thereby eliminating the need for the user to reprime the spray head 128. Furthermore, the float valve assembly 116, when the dosing chamber 108 is empty of all product 112 or the product level drops below the float valve assembly 116, causes the trigger 136 of spray head 128 to pump hard (i.e., the trigger 136 becomes difficult to depress) and spray from the nozzle 134 will be noticeably different which will alert the user to refill the dosing chamber 108 with product 112. FIGS. 5A-B and 6A-B illustrate a pair of float valve assemblies 116 of the present invention. The float valve assembly 116 illustrated in FIGS. 5A-B includes a valve 124 having floatably contained therein a float 122 moveable between a floating position and a blocking position of inlet 118. Inlet 118 is in fluid communication with outlet 120. Likewise, outlet 120 is in fluid communication with dip tube 114. When the product 112 level within the dosing chamber 108 drops below the float 122, the float 122 seats against inlet 118 to prevent air from within the dosing chamber 108 from being drawn into the float valve assembly 116, through dip tube 114 and into spray head 128. Conversely, when the product 112 level within dosing chamber 108 is above inlet 118, float 122 due to its inherent buoyancy, is raised so as to unblock inlet 118 to allow product 112 to flow through inlet 118, outlet 120, dip tube 114, and through spray head 128 onto a desired surface when trigger 136 is activated. In FIGS. 6A-B, the float valve assembly 116 includes a plurality of inlets 118 in fluid communication with an outlet 120. The outlet 120 is in fluid communication with dip tube 114. Depending upon the level of product 112 in the dosing chamber 108, the float 122 moves up and down along valve 124. Float stop 123 prevents the float 122 from raising up off of the valve portion 124 of the assembly 116. When the product 112 within dosing chamber 108 drops below the inlets 118, float 122 descends downward and seats over top of inlets 118 to block off the inlets 118. This prevents air within the dosing chamber 108 from being drawn into the float valve assembly 116 and ultimately into the spray head 128. Likewise, as the inlets 118 are blocked off by the float 122, the trigger 136 of spray head 128 becomes noticeably stiff, thereby notifying the user of the need to refill the dosing chamber 108 with product 112 from the main chamber 106 according to the process illustrated in FIG. 7 and detailed above.

Figure 9:
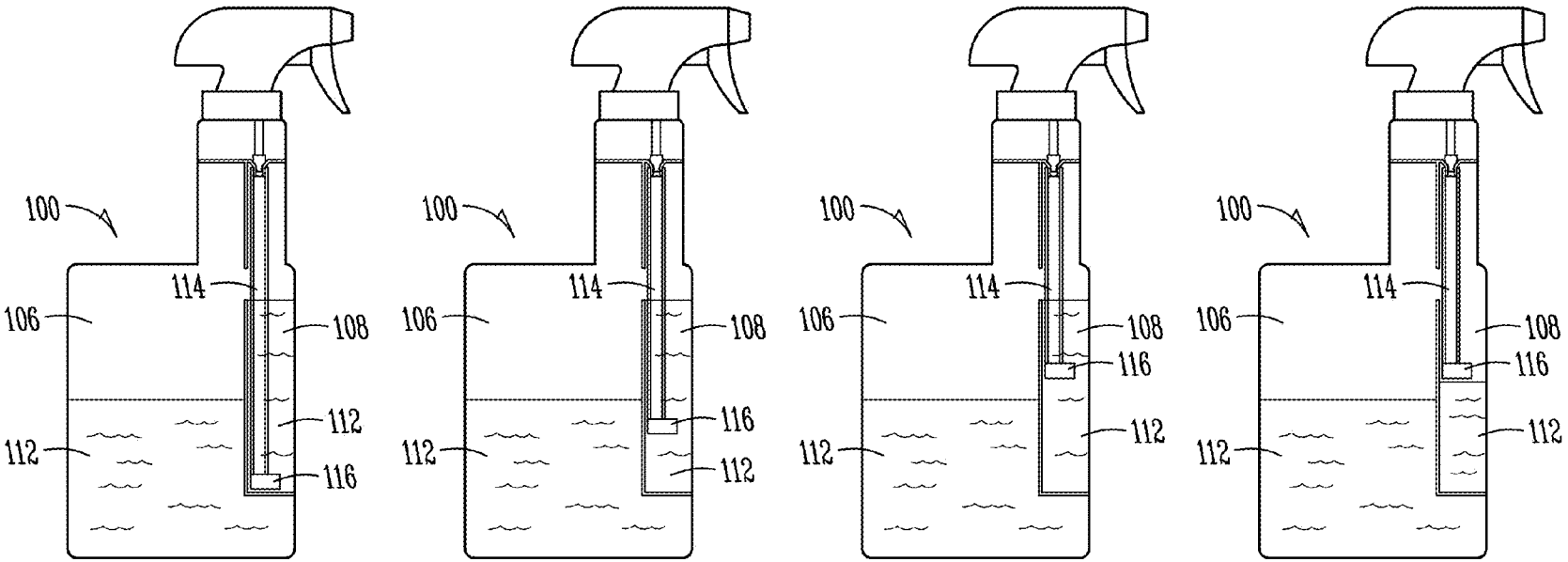
FIG. 9 illustrates changes in the dip tube length to increase or decrease the amount of product dispensed from the dosing chamber.

The present invention also contemplates other means for controlling the amount of product being metered from the dosing chamber 108 onto a surface using spray head 128. Since only product at or above the level of the inlet of the dip tube 114 or the float valve 116 (i.e., above the suction level) is dispensed, the length of the dip tube 114 may be adjusted as shown in FIG. 9 to control the amount of product 112 that is dispensed from the dosing chamber 108. In the case where the dip tube 114 is shortened in length, the level of the float valve 116 within the dosing chamber 108 is raised (i.e., the suction level is raised) and the amount of product 112 that can be metered from the dosing chamber 108 is reduced commensurate with the position of the float valve assembly 116 within dosing chamber 108. Alternatively, if the amount of product 112 to be dispensed is to be increased in embodiments of the present invention, the dip tube 114 may be lengthened so that the float valve assembly 116 is positioned lower within the dosing chamber 108, thereby allowing the product 112 in the dosing chamber 108 at or above the float valve 116 to be dispensed onto a surface or into the surrounding air space.

According to the present invention, exact amounts of product are metered onto a surface or into the air based upon the cleaning and/or deodorizing operation and the product used. As illustrated in FIG. 2B, the correct dosing chamber 108 may be selected based on the desired amount of product to be dispensed and inserted into the container 102. In the case where a cleaning or deodorizing operation requires a different product dosage, the user can replace the existing dosing chamber 108 in the container 102 with the correct dosing chamber. Several dosing chambers 108 may be used with a single dispensing system 100. A dosing chamber 108 may also be specified for a specific product. Similarly, multiple dosing chambers 108 may be used when multiple products are involved in a single cleaning and/or deodorizing operation.

In another embodiment of the present invention, the dispensing system 100 includes container 102 as described above having both a main chamber 106 and a dosing chamber 108, preferably separated by a divider 107. The container 102 includes a neck portion 103 having an opening in communication with main chamber 106 and dosing chamber 108. In one aspect of the invention, a nozzle interface 126 may be included that is removably received within the neck portion 103 (such as illustrated in FIG. 2B and discussed above). The nozzle interface 126 may include a portion of the divider 107 for further separating the main chamber 106 from the dosing chamber 108 when the nozzle interface 126 is installed the neck portion 103 of the container 102. The nozzle interface 126 also may include a fill opening 104 and a dispense opening 105. A dip tube 114 is removably or fixedly secured to the dispense opening 105 of the nozzle interface 126. In another aspect, the dip tube 114 is removably or fixedly secured directly to the spray head 128 or a pickup tube 138 of the spray head 128. In both aspects, the dip tube 114 includes a float valve 116 as described above. The dispensing system 100 is configured so that the spray head 128 is removably secured to the neck portion 103 of the container 102 using a threaded collar 142 as discussed above. When the spray head 128 is separated from the container 102, the dip tube 114 and float valve 116 are removed from within the dosing chamber 108 in one aspect, and the dip tube 114, float valve 116, nozzle interface 126, and pickup tube 138 are removed from the dosing chamber 108 and neck portion 103 of the container 102 in another aspect of the invention. With the dispensing system 100 disassembled, the main chamber 106 is filled with product as described above. The spray head 128 and other components, such as the dip tube 114 and float valve 116, are reinserted into the container 102 when the spray head 128 is connected to the container 102 or before the spray head 128 is connected to the container in the case where the nozzle interface 126 is used to connect the pickup tube 138 on the spray head 128 with the dip tube 114 on the nozzle interface 126. In either case, these components may be removed from the container 102 when the spray head 128 is separated from the container 102.

Although the specific embodiments have been illustrated and described herein, it will be appreciated by those of ordinary skill in the art that any arrangement, which is calculated to achieve the same purpose, may be substituted for the specific embodiment shown. This application is intended to cover any adaptations or variations of the present invention. Therefore, it is manifestly intended that this invention be limited only by the claims and the equivalence thereof.

What is claimed is:

1. A dispensing system comprising:

a container body extending upward and terminating in a neck portion, the container having:

a) a main chamber to hold product;

b) a dosing chamber having an opening in communication with the main chamber, the dosing chamber configured to hold a metered amount of product received from the main chamber, the metered amount corresponding to a single dose of the product; and c) a divider having a portion substantially transverse for an upper portion that separates, in part, the main chamber and the dosing chamber;

a spray nozzle removably connected to the container body; and a dip tube connected in fluid communication with the spray head and positioned within the dosing chamber.

2. The dispensing system of claim 1 wherein the dip tube further comprises a float valve within the dosing chamber and configured to prevent air from entering the dip tube.

3. The dispensing system of claim 2 wherein the float valve includes an inlet in communication with the dip tube closeable by a float.

4. The dispensing system of claim 1 wherein the neck portion includes a nozzle interface having a first opening in communication with the main chamber separated from a second opening in communication with the dosing chamber.

5. The dispensing system of claim 4 wherein the second opening includes an interface adapted to receive a tube nozzle associated with the spray head.

6. The dispensing system of claim 4 wherein the first opening is configured and arranged to receive a filling tube from a product dispenser.

7. The dispensing system of claim 1 wherein the spray head includes a pickup tube terminating in a nozzle removably coupled to the dip tube.

8. A bottle for a dispensing system comprising:

a container body extending upward and terminating in a neck portion;

a main chamber to hold product; and a dosing chamber having a chamber opening in communication with the main chamber, the dosing chamber configured to hold a metered amount of product received from the main chamber, the metered amount corresponding to a single correct dose of the product; and a divider separating the main chamber and the dosing chamber with an opening passing therethrough, the divider including a substantially vertical upper portion, lower portion, and a chamber opening in communication with the main chamber, and a substantially horizontal portion at an upper end of the upper portion.

9. The bottle of claim 8 further comprising a dip tube positioned within the dosing chamber and affixed at the neck portion.

10. The bottle of claim 8 wherein the neck portion includes a first opening in communication with the main chamber separated from a second opening in communication with the dosing chamber.

11. The bottle of claim 10 wherein the second opening includes a nozzle interface adapted to selectively receive a pickup tube associated with a spray head.

12. The bottle of claim 10 wherein the first opening is configured and arranged to receive a filling tube from a product dispenser.

13. The bottle of claim 8 wherein the dosing chamber is removably attached within the container body.

14. A combination of a spray head and a spray bottle for a dispensing system comprising:

a neck having a coupler for selectively attaching the spray head to a dispensing bottle;

a spraying nozzle configured to dispense product;

a pickup tube connected in fluid communication with the spraying nozzle;

a bottom end of the pickup tube having a nozzle configured for selective coupling to a dip tube; and a spray bottle having a main chamber to hold product, the main chamber having a top and a bottom, and a dosing chamber in the main chamber having a divider, the divider including an upper portion, a lower portions, and a chamber opening in communication with the main chamber, the upper portion being adjacent the top of the main chamber, and wherein the divider including a portion substantially transverse the upper portion, the dosing chamber configured to hold only a metered single dose of product received from the main chamber.

15. The combination of claim 14 wherein the dosing chamber includes the dip tube.

16. A method for a dispensing system comprising:

providing a bottle having a neck, a main chamber, the main chamber having a top and a bottom, an interchangeable dosing chamber in the main chamber, the dosing chamber having a divider with an upper portion and a lower portion, the upper portion being adjacent the top of the main chamber, wherein the divider including a portion substantially transverse the upper portion, and a dip tube within the dosing chamber and including a float valve, wherein the length of the dip tube and position of the float valve are adjustable to provide a variable amount of product in the dosing chamber that is able to be dispensed;

filling the main chamber with a product;

taking a spray nozzle having a pickup tube terminating in a connector nozzle;

removably securing the spray nozzle to the bottle for coupling the connector nozzle to the dip tube; and tipping the spray bottle from a generally upright position to fill the dosing chamber with a single correct dose of the product from the main chamber.

17. The method of claim 16 comprising dispensing product from the dosing chamber.

18. The method of claim 16 comprising preventing air from entering the dip tube when the dosing chamber is emptied by closing a float valve secured to the dip tube within the dosing chamber.

19. The method of claim 18 comprising adjusting the length of the dip tube to control an amount of the product dispensed from the dosing chamber.

20. The method of claim 16 comprising filling the main chamber through a first opening in the bottle and dispensing product with the spray nozzle through a second opening in the bottle.

* * * * *